United States Patent [19]

Murase et al.

[11] Patent Number: 4,848,288

[45] Date of Patent: Jul. 18, 1989

[54] STARTING APPARATUS

[75] Inventors: Kenaki Murase; Toshinori Morishige, both of Tokyo, Japan

[73] Assignee: Starting Industry Co., Ltd., Japan

[21] Appl. No.: 152,998

[22] Filed: Feb. 8, 1988

[30] Foreign Application Priority Data

| | | | |
|---|---|---|---|
| May 19, 1987 | [JP] | Japan | 62-121758 |
| May 19, 1987 | [JP] | Japan | 62-74871[U] |
| Oct. 11, 1987 | [JP] | Japan | 62-171688[U] |
| Nov. 10, 1987 | [JP] | Japan | 62-171687[U] |
| Nov. 10, 1987 | [JP] | Japan | 62-171686[U] |

[51] Int. Cl.[4] ..... F02N 3/02; F02N 11/00

[52] U.S. Cl. ..... 123/179 P; 74/6; 74/625

[58] Field of Search ..... 123/179 P, 179 M, 179 SE, 123/185 A, 185 B, 185 BA; 74/6, 625

[56] References Cited

U.S. PATENT DOCUMENTS

| | | | |
|---|---|---|---|
| 2,563,719 | 8/1951 | Goldberg et al. | 123/185 BA |
| 2,939,448 | 6/1960 | Hansen | 123/179 P |
| 3,219,021 | 11/1965 | Mercer et al. | 123/179 P |
| 4,157,083 | 6/1979 | Smith et al. | 123/179 P |

*Primary Examiner*—Andrew M. Dolinar

*Attorney, Agent, or Firm*—Wall and Roehrig

[57] ABSTRACT

A starting apparatus for small-sized engines which is composed of a combination of a cell motor and a recoil starter is disclosed. A rotor gear is loosely fitted on a support shaft of the recoil starter on which a reel is supported, and the rotor gear is also meshed with a pinion gear constituting a reduction gear of the cell motor which is disposed side by side with the recoil starter. When the recoil starter is used, the rotor gear is rotated through the reel. When either the cell motor or the recoil starter is actuated, the rotor gear is rotated only in the forward direction by the function of a one-way clutch (including a ratchet type one-way clutch), whereas, when the reel or the pinion gear rotates reversely, they race but do not cause the rotor gear to rotate by the function of the one-way clutches. The forward rotation of the rotor gear is used to drive a pulley which is secured to the crankshaft, thus starting the engine. Accordingly, the engine is normally started using the cell motor, and when the battery is dead and it is therefore difficult to start the engine with the cell motor, the engine can be started using the recoil starter. Therefore, it is possible to start the engine without worrying about the battery even after the machine has been left to stand for a certain period of time.

2 Claims, 4 Drawing Sheets

STARTING APPARATUS

BACKGROUND OF THE INVENTION

1. Field of the Invention

The present invention relates to a starting apparatus for small-sized engines which is composed of a combination of a cell motor (electrically-driven starting motor) and a recoil starter.

2. Description of the Related Art

In the conventional starting apparatuses for agricultural implements, a cell motor and a recoil starter have heretofore been used independently of each other, and it is conventional practice to decide whether the recoil starter or the cell motor is to be used as a starter in accordance with the kind of work machine on which the engine is mounted, the capacity and economic factor of the engine, etc.

Recently, the number of starting apparatuses which employ cell motors in place of recoil starters has been increasing. However, agricultural implements are seasonal, that is, they are used only in their own fixed periods of time, and therefore the starting apparatuses that employ cell motors suffer from the problem that, when an agricultural implement is to be used after being left to stand for a certain period of time, it may fail to start due to the battery being dead.

SUMMARY OF THE INVENTION

Accordingly, it is a primary object of the present invention to provide a starting apparatus which is composed of a combination of a cell motor and a recoil starter so that it is possible to start the engine even when the battery is dead as in the case described above.

To this end, according to the present invention, a rotor gear is loosely fitted on a support shaft of a recoil starter on which a reel is supported, and the rotor gear is also meshed with a pinion gear constituting a reduction gear of a cell motor which is disposed side by side with the recoil starter. When the recoil starter is used, the rotor gear is rotated through the reel. When either the cell motor or the recoil starter is actuated, the rotor gear is rotated only in the forward direction by means of a one-way clutch (including a ratchet type one-way clutch), whereas, when the reel or the pinion gear rotates reversely, they race but do not cause the rotor gear to rotate by the function of the one-way clutches. The forward rotation of the rotor gear is used to drive a pulley which is secured to the crankshaft, thus starting the engine.

By virtue of the above-described arrangement, when the rope is pulled at the recoil starter side, the reel and the rotor gear rotate forwardly, and the crankshaft is thereby rotated forwardly through the engagement between the rotor gear and the pulley. However, since the pinion gear races by the function of the one-way clutch, the rotation of the pinion gear is not transmitted to the cell motor. On the other hand, when the cell motor is actuated, the rotor gear is rotated through the pinion gear, thus causing the crankshaft to rotate. In the case also, no rotation is transmitted to the reel by the function of the one-way clutch, that is, the ratchet.

Accordingly, the engine is normally started using the cell motor, and when the battery is dead and it is therefore difficult to start the engine with the cell motor, the engine can be started using the recoil starter. Therefore, it is possible to start the engine without worrying about the battery even after the machine has been left to stand for a certain period of time. Further, since the cell starter and the recoil starter are arranged together in one unit, it is possible to provide the starting apparatus at a lower cost than in the case of the prior art in which the two different kinds of starter are provided seperately from each other.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements, and in which.

DESCRIPTION OF THE PREFERRED EMBODIMENTS

The present invention will be described hereinunder in detail with reference to the accompanying drawings.

Figure 1:
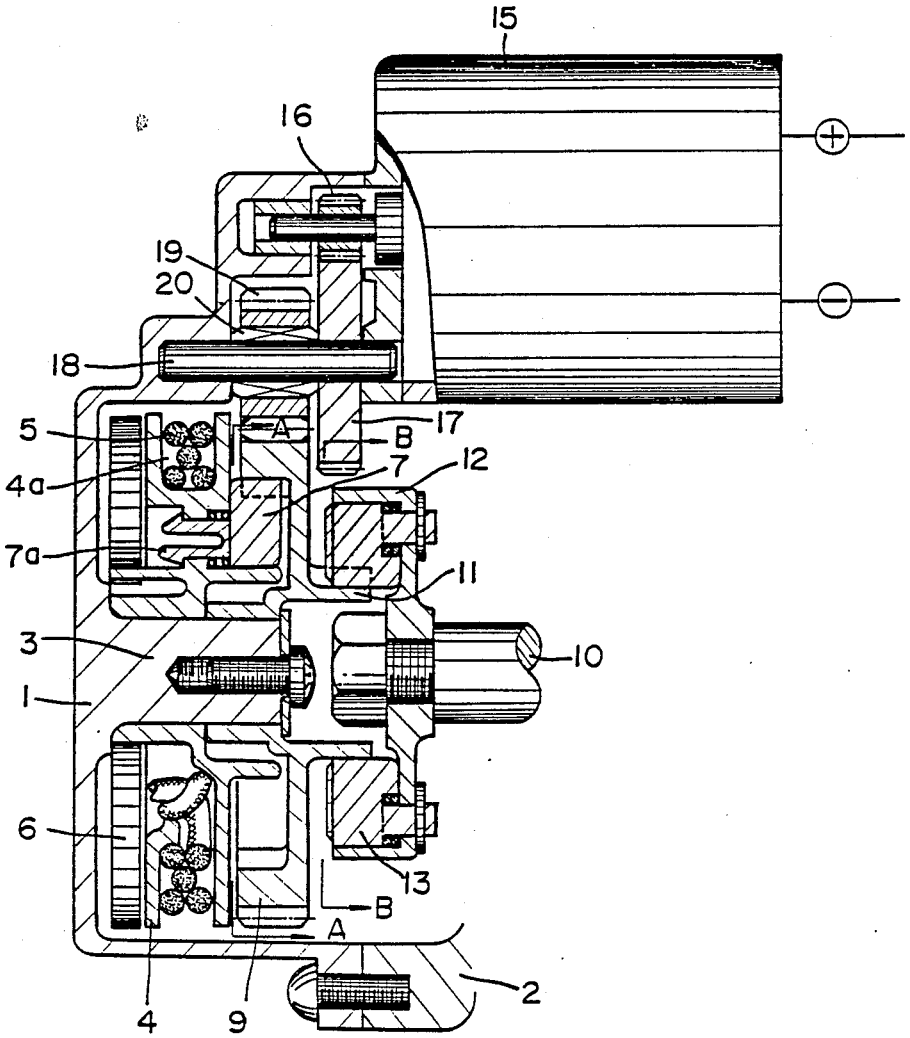
FIG. 1 is a sectional view of one embodiment of the starting apparatus according to the present invention.
Figure 2:
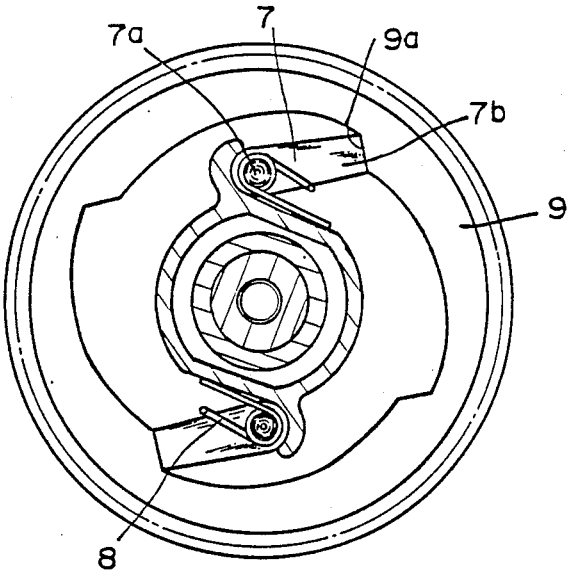
FIG. 2 is a sectional view taken along the line A—A of FIG. 1.
Figure 3:
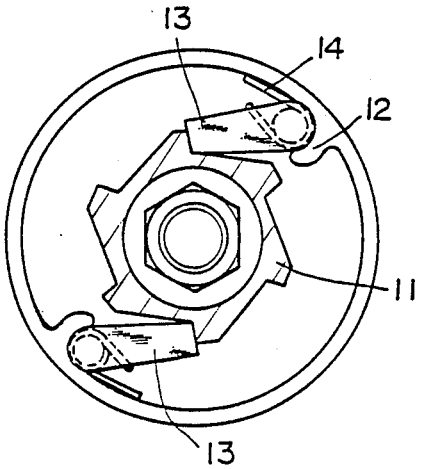
FIG. 3 is a sectional view taken along the line B—B of FIG. 1.

Referring first to FIGS. 1 to 3, the reference numeral 1 denotes a casing of a recoil starter which is secured to a crank case 2. A support shaft 3 is formed integral with the recoil starter casing 1 so that the support shaft 3 projects from the inner central portion of the casing 1. A reel 4 is rotatably mounted on the support shaft 3. The outer peripheral portion of the reel 4 is provided with a recess **4*a* for accommodating a rope 5. Between the reel 4 and the casing 1 is provided a rewinding spring 6 which is arranged such that, when the operator releases his hand from the rope 5 after unwinding the rope 5, the rope 5 is rewound so as to be accommodated in the recess 4*a* again. A first ratchet 7 is provided on one side surface of the reel 4. A shaft portion 7*a* which is provided at one end of the ratchet 7 is pivotally received in a bore which is provided in the reel 4. A stopper portion 7*b* is provided at the other end of the ratchet 7. Normally, the ratchet 7 is biased outward by means of the force from a return spring 8 as shown in FIG. 2. The reference numeral 9 denotes a rotor gear which is loosely fitted on and thus supported by that end portion of the support shaft 3 which is closer to a crankshaft 10. The rotor gear 9 has a circular cam groove provided in one side surface thereof. A recess 9*a* is provided in the peripheral wall of the circular groove so that the stopper portion 7*b* of the ratchet 7 is engageable with the recess 9*a*. Thus, when the reel 4 rotates forwardly, the rotor gear 9 rotates together with the reel 4, whereas, when the reel 4 rotates reversely, it races, but the rotor gear 9 does not rotate. In other words, the above-described members constitute in combination a ratchet type one-way clutch. A cam shaft which has a cam 11 projects from that side of the rotor gear 9 which is closer to the crankshaft 10. A pulley 12** is secured to the crankshaft 10, and a second ratchet 13 is provided on one side surface of the pulley 12, the ratchet 13 facing the cam 11 so as to be engageable therewith. The ratchet 13 is biased by a return spring 14 so that the ratchet 13 is constantly engaged with the cam 11. Thus, when the cam 11 rotates in one direction, the pulley 12 rotates together with it. However, when the cam 11 rotates in the other direction, the cam 11 races, and the pulley 12 is therefore not driven. In other words, the cam 11 and the ratchet 13 constitute in combination a ratchet type one-way clutch.

A cell motor 15 is also secured to the starter casing 1 in parallel to the recoil starter. The shaft of the cell motor 15 causes an intermediate shaft 18 to rotate through reduction gears 16, 17. A pinion gear 19 is secured to the shaft 18 in such a manner that the pinion gear 19 is meshed with the above-described rotor gear 9. A conventional one-way clutch 20 is provided on the pinion gear 19 so that the rotor gear 9 is allowed to rotate only in the forward direction but it is prevented from rotating in the reverse direction.

The following is a description of the operation of the above-described embodiment.

In the case where the cell motor 15 is used to start the engine, when a start button (not shown) is depressed, the shaft of the cell motor 15 rotates, and the intermediate shaft 18 rotates through the reduction gears 16, 17. Further, the pinion gear 19 is allowed to rotate by the function of the one-way clutch 20, thus causing the rotor gear 9 to rotate. Accordingly, the cam 11 provided on the rotor gear 9 engages with the centrifugal ratchets 13 which are pivotally mounted on the pulley 12, causing the pulley 12 to rotate, and thus starting the engine.

In the case where the recoil starter is used to start the engine, when a starter handle (not shown) is pulled, the reel 4 rotates through the rope 5. At this time, the ratchets 7 which are pivotally mounted on the reel 4 engage with the recesses **9*a* of the rotor gear 9, causing the rotor gear 9 to rotate. In consequence, the pulley 12 is rotated through the ratchets 13, thus enabling the engine to be started. It should be noted that, when the recoil starter is actuated, the pinion gear 19 alone races by the function of the one-way clutch 20 provided on the pinion gear 19, so that there is no effect on the motor 15. After the engine has been started, the second ratchets 13 are centrifugally thrust outward against the return springs 14 and thereby disengaged from the cam 11 provided on the rotor gear 9**.

Figure 4:
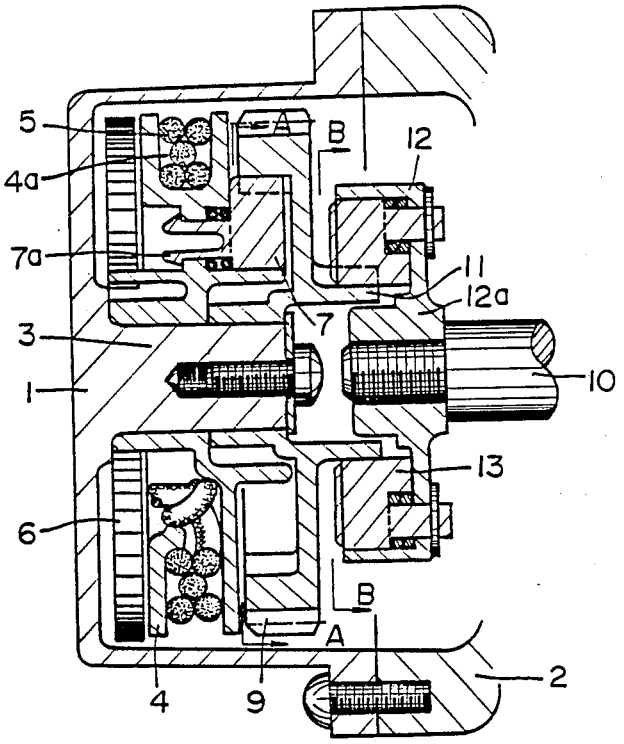
FIG. 4 is a sectional view showing the relationship between the cam and the boss of the pulley.

Although in this case it is possible to employ various kinds of transmission arrangement for starting the engine by the cell motor, for example, Bendix drive, employment of the centrifugal ratchet type clutch is advantageous from the viewpoint of cost. However, the centrifugal ratchet type clutch has a fear that the ratchets 13 will not necessarily mesh with the cam 11 uniformly (i.e., symmetrically). In such a case, eccentric force acts on the cam 11 so as to bend the support shaft 3 of the starter casing 1. The arrangement shown in FIG. 4 aims at preventing the support shaft 3 from being bent, in which the pulley 12 is provided with a boss **12*a* so that the boss 12*a* enters the inside of the cam 11 of the rotor gear 9 with a slight gap provided between the inner peripheral wall of the cam 11 and the outer peripheral wall of the boss 12*a***.

By virtue of the above-described arrangement, if the cam 11 has a predetermined amount of eccentricity when the ratchets 13 are meshed with the cam 11, the cam 11 abuts against the boss **12*a*** and is therefore deformed no more. Thus, it is possible to prevent occurrence of the above-described problem.

Since in the above-described arrangement a pair of right and left ratchets 13 are provided, there may be some play between the ratchets 13 and the cam 11 when they are meshed, and there is therefore a fear of the ratchets 13 meshing with the cam 11 when the rotational speed of the motor 15 is relatively high. The meshing impact at that time is considerably large, so that the constituent elements may be damaged.

Figure 5:
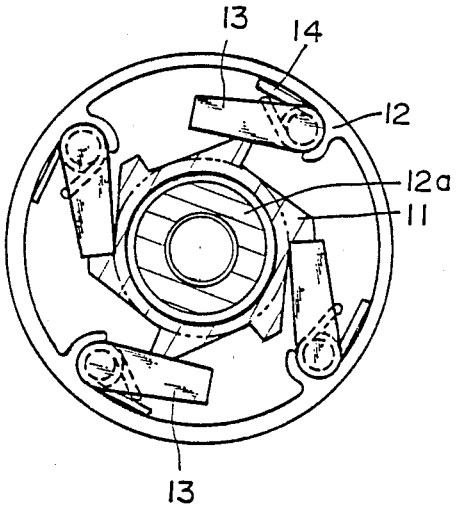
FIG. 5 shows the relationship between the cam portions and the ratchets.

FIG. 5 shows an arrangement which enables a reduction in the above-described meshing impact. In the illustrated arrangement, the rotor gear 9 is provided with six cam portions 11, and the pulley 12 is provided with four ratchets 13 which are engageable with the cam portions 11, the cam portions 11 and the ratchets 13 being disposed at equal spacings, respectively.

The reason why the numbers of cam portions 11 and ratchets 13 are defined as described above is that, although the play between the cam portions 11 and the ratchets 13 when they are meshed with each other is reduced as said numbers are increased, employment of excessively large numbers of cam portions 11 and ratchets 13 lowers the structural strength and also complicates the mechanism. Therefore, most of the principal constituent elements are made of a resin material to reduce the overall weight and, at the same time, lower the production cost.

Figure 6:
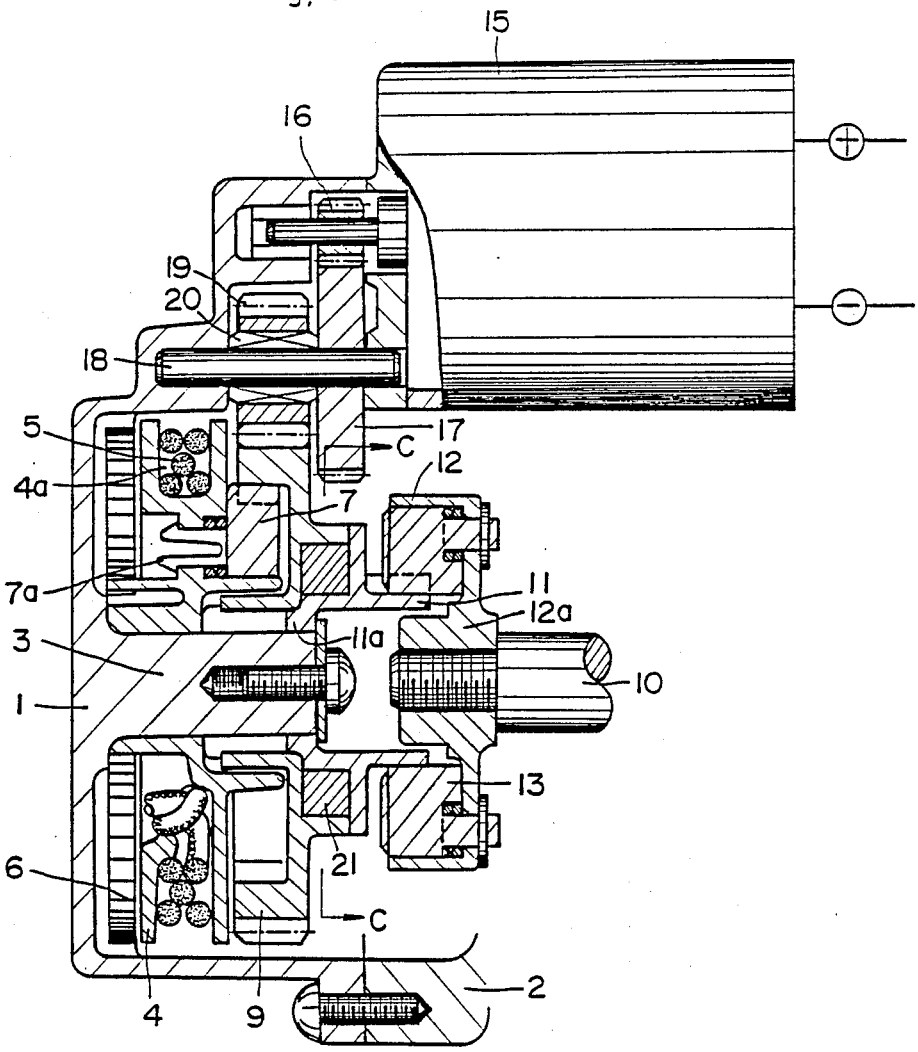
FIG. 6 is a sectional view showing another embodiment of the present invention.
Figure 7:
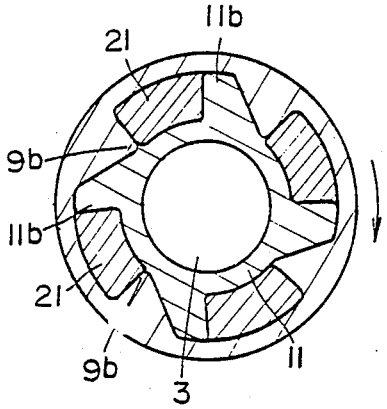
FIG. 7 is a sectional view taken along the line C—C of FIG. 6.

Another embodiment of the present invention will next be described with reference to FIGS. 6 and 7. As illustrated, the starting apparatus according to this embodiment is similar to the above-described starting apparatus according to the first embodiment in that the engine is started by the cell motor through the rotor gear 9 by means of the rotational force transmitted from the cell motor 15 to the rotor gear 9 through the one-way clutch 20 after the speed thereof has been reduced and the engine is also started by the recoil starter through the rotor gear 9 which is driven by means of the rotational force transmitted from the reel 4. However, the second embodiment differs from the first embodiment in that the input portion (i.e., the gear portion and the recess **9*a* for engagement with the recoil starter) of the rotor gear 9 and the cam 11 which defines the output portion of the rotor gear 9 are formed as being members which are separate from each other and the rotor gear 9 and the cam 11 are provided with a plurality of projections 9*a* and 11*b*, respectively, which are engageable with each other with an impact damping damper 21 disposed between each pair of projections 9*a* and 11*b***.

By virtue of the above-described arrangement, when the rope is pulled at the recoil starter side, the reel 4 and the rotor gear 9 are rotated, and the cam 11 is thereby rotated through the rotor gear 9 and the dampers 21, thus causing the crankshaft 10 to rotate forwardly through the pulley 12. When the cell motor 15 is actuated, the rotor gear 9 rotates through the pinion gear 19, causing the crankshaft 10 to rotate through the rotor gear 9 as described above. Thus, at the time of starting of the engine using either the motor 15 or the recoil starter, when the rotor gear 9 and the cam 11 are loaded in the direction of rotation, the dampers 21 are compressed in accordance with the magnitude of load. Accordingly, it is possible to absorb the meshing impact at the time of starting the engine and also absorb the meshing impact resulting from the reverse rotation at the time when the engine is suspended, and it is therefore possible to reduce the load applied to various portions of the constituent elements. Thus, it is possible to form the rotor gear and other elements using a resin material or the like and it is advantageously possible to prevent damage of the elements and, at the same time, reduce the overall weight.

Although the present invention has been described through specific terms, it should be noted here that the described embodiments are not necessarily exclusive and various changes and modifications may be imparted thereto without departing from the scope of the invention which is limited solely by the appended claims.

What is claimed is:

1. A starting apparatus for a small-sized engine comprising:

a recoil starter having a casing mounted on an engine crankcase;

a support shaft integral with and projecting from said recoil starter assembly;

a reel and a rotor gear rotatably mounted on said support shaft;

a circular cam groove on the top of said rotor gear;

six cam portions provided on the underside of said rotor gear;

a cell motor mounted side-by-side with said recoil starter on said starter casing, said cell motor having a reduction gear, and a one-way clutch on said reduction gear;

a first ratchet assembly mounted on the underside of said reel for one-way engagement with said circular cam groove in the top of said rotor gear;

a pulley mounted on the engine crankshaft in rotary alignment with said rotor gear;

a second ratchet assembly mounted on said pulley for engagement with said cam portions;

said ratchet assemblies and one-way clutch assembly being disposed to allow said rotor gear to be selectively rotated in one direction only by said recoil starter and cell motor to rotate the crankshaft of said engine.

2. A starting apparatus according to claim 1 wherein said pulley is provided with upwardly projecting boss, which boss engages the inside of said cam portions of said rotor gear for alignment support.

* * * * *